United States Patent [19]

Holleis et al.

[11] Patent Number: 4,523,623

[45] Date of Patent: Jun. 18, 1985

[54] PLATE MOULD FOR CONTINUOUS CASTING

[75] Inventors: Günter Holleis; Horst Wiesinger, both of Linz, Austria

[73] Assignee: Voest-Alpine Aktiengesellschaft, Linz, Austria

[21] Appl. No.: 422,873

[22] Filed: Sep. 24, 1982

[30] Foreign Application Priority Data

Oct. 9, 1981 [AT] Austria ..... 4340/81

[51] Int. Cl.[3] ..... B22D 11/12; B22D 33/04

[52] U.S. Cl. ..... 164/436; 164/341; 164/443

[58] Field of Search ..... 164/418, 436, 459, 491

[56] References Cited

U.S. PATENT DOCUMENTS 4,069,863 1/1978 Hargassner et al. ..... 164/436
4,085,793 4/1978 Scheinecker et al. ..... 164/443 X

FOREIGN PATENT DOCUMENTS 1919710 11/1970 Fed. Rep. of Germany ..... 164/418
2743025 3/1978 Fed. Rep. of Germany ..... 164/436
103261 8/1980 Japan ..... 164/436

*Primary Examiner*—Howard N. Goldberg
*Assistant Examiner*—Timothy V. Eley
*Attorney, Agent, or Firm*—Brumbaugh, Graves, Donohue & Raymond

[57] ABSTRACT

A plate mould for continuous casting includes a carrying frame and broad-side walls supported therein and delimiting the mould cavity. Between the broad-side walls, end walls are arranged. The broad-side walls are adjustable normal to the axis of the mould cavity by an adjustment device and clampable relative to each other by a clamping device. In order to enable a perfect movement of the broad-side walls in the direction normal to the axis of the mould cavity, which is simple to maintain and adjust by the maintenance personnel, and to provide an easy installation and removal of the mould insert, each broad-side wall is clampable in the vertical direction by at least one clamp strap, against a holding plate of the carrying frame supporting the broad-side wall. The clamp strap is supported on the broad-side wall and on the carrying frame and clampable against the carrying frame in the manner of a bending carrier by a tensioning device that is detachable from the upper side of the mould.

7 Claims, 4 Drawing Figures

PLATE MOULD FOR CONTINUOUS CASTING

BACKGROUND OF THE INVENTION

The invention relates to a plate mould for continuous casting, in particular for the continuous casting of steel slabs, comprising a carrying frame and broad-side walls supported therein and delimiting the mould cavity, between which end walls are arranged, the broad-side walls being adjustable normal to the axis of the mould cavity by adjustment means and clampable relative to each other by clamping means.

A mould of this kind is known from U.S. Pat. No. 4,085,793. In order to exclude safely a co-reciprocation of the mould side walls with the reciprocating strand, the side walls are screwed to a holding means of the carrying frame, supporting these side walls, by screws that are accessible from the mould lower side. One of the broad-side walls, with the known construction, is rigidly mounted to the carrying frame and the second broad-side wall is mounted so as to be movable in the direction normal to the axis of the mould cavity in order to be able to perform movements caused by changes in elongation of the end walls. These movements are made possible by adjusting a play between the screws of the broad-side wall accommodating the upwardly directed vertical forces and the holding means supporting the same. However, jamming might occur in the event of an insufficient maintenance of the mould, in particular if the end walls have assumed their original format after cooling of the mould prior to a new casting onset. If, in this case, the broad-side wall does not follow the contraction of the end wall, a gap may form between the broad-side walls and the end walls, which is responsible for an outbreak of melt at the onset of casting.

The invention aims at avoiding these difficulties and has as its object to provide a mould that is equipped with a mounting means for the broad-side walls, enabling a perfect movement of the broad-side walls in the direction normal to the axis of the mould cavity, which is simple to maintain and adjust by the maintenance personnel. Furthermore, this holding means is to provide an easy installation and removal of the mould insert, i.e., of the broad-side and end walls.

SUMMARY OF THE INVENTION

This object is achieved according to the invention in that each broad-side wall is clampable in the vertical direction by means of at least one clamp strap, against a holding plate of the carrying frame supporting the broadside wall, the clamp strap being supported on the broadside wall on the one hand and on the carrying frame on the other hand, and clampable against the carrying frame in the manner of a bending carrier by a tensioning means that is detachable from the upper side of the mould.

A good movability of the broad-side walls with a view to different operational conditions preferably is ensured by providing, between each broad-side wall and the holding plate, as well as between the end parts of the clamp straps supported on the broad-side walls and the broad-side walls, bearings that facilitate a displacing movement of the broad-side wall.

According to a preferred embodiment, the bearings are designed as slide bearings, in particular with sliding surfaces of bronze.

To meet particularly high demands, the bearings are designed as antifriction bearings, in particular as roundway bearings.

A preferred embodiment is characterized in that one of the two broad-side walls is supported against the carrying frame by means of adjustable stops and the broad-side wall opposite the same is pressable toward the first one by a clamping means. With this embodiment the total mould insert, i.e. the insert consisting of end walls and broadside walls arranged in the carrying frame, is displaceable in a simple manner normal to the axis of the mould cavity for adjusting the alignment with a strand supporting and guiding stand arranged after the mould, without having to change the position of the carrying frame itself relative to the lifting table.

BRIEF DESCRIPTION OF THE DRAWINGS

The invention will be explained in detail by way of two embodiments and with reference to the accompanying drawings, wherein.

DESCRIPTION OF EXEMPLARY EMBODIMENTS

Figure 1:
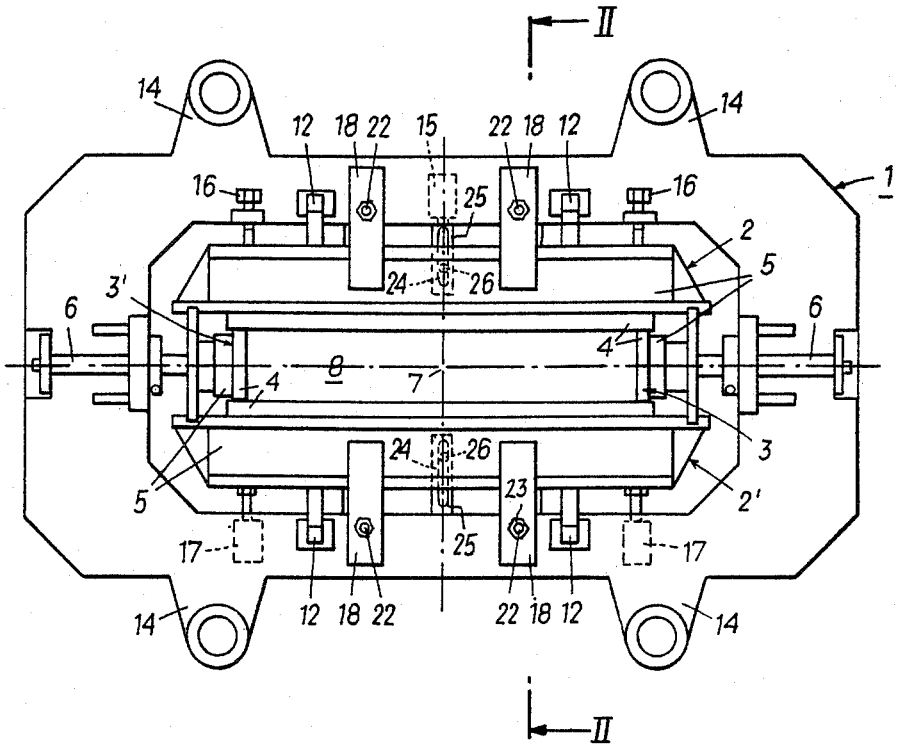
FIG. 1 is a top view of a mould.
Figure 2:
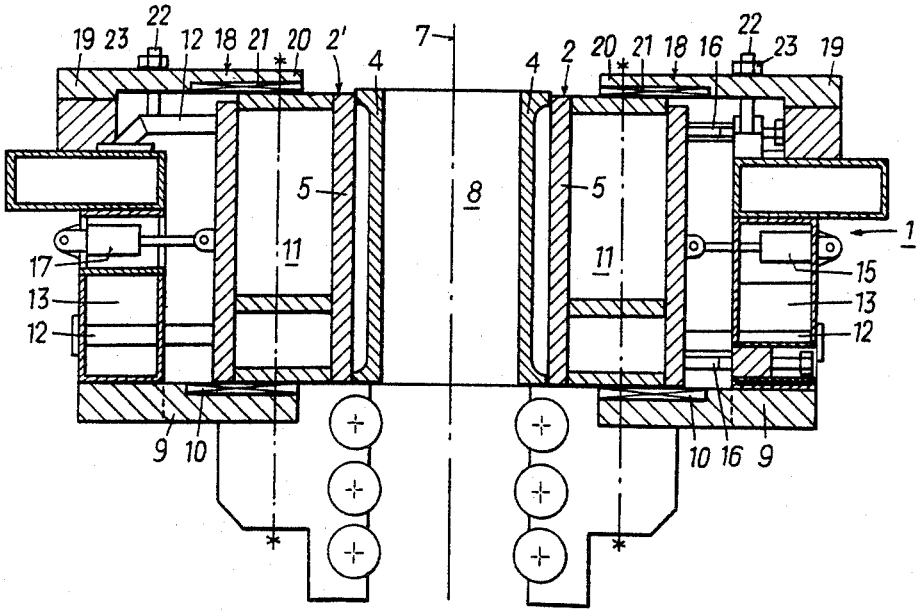
FIG. 2 is a sectional view taken along the line II—II of FIG. 1 through a mould according to a first embodiment.

In a carrying frame 1 of a plate mould which is designed as a water box, two broad-side walls 2, 2' and two end walls 3, 3' are arranged. On the sides facing each other, the side walls 2, 2', 3, 3' of the mould have copper plates 4 that contact the melt and are supported by hollow supporting walls 5 through which a coolant flows. The end walls 3, 3' are inserted between the broad-side walls 2, 2' and are clamped between the broad-side walls 2, 2' by pressing the same toward each other. To adjust the width format of the mould, adjustment drives 6 are provided for the end walls 3, 3', by which the end walls are adjustable normal to the longitudinal axis 7 of the mould cavity 8.

The side walls 2, 2' are supported on a holding plate 9 of the carrying frame 1, which engages the side walls from below, bearings 10 being provided between the broadside walls 2, 2' and the holding plate 9. It is possible to provide, for instance, slide bearings with sliding surfaces of bronze, or antifriction bearings, such as roundway bearings.

The cavity 11 of the broad-side and end walls 2, 2', 3, 3' is connected with the cavity 13 of the carrying frame via coolant supply and discharge tubes 12, which are designed as plug-type connections. The carrying frame 1 itself is fastened to the lifting table carrying out the reciprocating movement by means of four brackets 14 and is connected by means of plug-type connections (not illustrated) for the coolant in a conduit-like manner.

One of the broad-side walls, i.e., the so-called fixed side wall 2, is pressed by a press-on means 15, for instance a hydraulically actuated cylinder or a pileup of springs, against an adjustment means 16 mounted on the carrying frame and designed as four adjustment screws in the embodiment illustrated. By turning the adjustment screws 16, the fixed side wall 2 can be exactly aligned with the strand guiding means following upon the mould.

The broad-side wall 2′ arranged opposite the fixed side wall 2 is pressed toward the broad-side wall forming the fixed side wall 2 with the end walls 3, 3′ interposed therebetween, by a clamping means 17, which may be designed as two hydraulically actuated cylinders or as pile-ups of springs.

For accommodating vertically upwardly directed forces—such forces occur during the downward movement of the mould when reciprocating due to the friction prevailing between the mould side walls 2, 2′, 3, 3′ and the strand skin—clamp straps 18 are provided on the upper side of the mould, each resting with one end 19 on the carrying frame 1 and with the other end 20 on a broad-side wall 2, 2′. Between each broad-side wall 2, 2′ and the ends 20 of the clamp straps 18 resting thereon, bearings 21 are also provided, for instance slide or antifriction bearings. Each clamp strap 18 can be clamped by a tensioning means 22, such as a tensioning screw 22 held on the carrying frame 1 and penetrating the clamp strap, vertically downwardly by bracing the broad-side walls 2, 2′. Suitably, the nut 23 of each tensioning screw, which is accessible from above, is tightened by a moment wrench so that clearly defined frictional conditions prevail on the bearings 10 and 21 between the holding plate 9 and the clamp straps 18 and the broad-side walls 2, 2′.

In order to center the broad-side walls 2, 2′ in the direction of their planes normal to the longitudinal axis 7 of the mould cavity 8, brackets 25 equipped with a long hole 24 are provided on the carrying frame 1, into which a pin 26 of each broad-side wall projects. The longitudinal axis of the long hole 24 is directed normal to the planes of the broad-side walls 2, 2′.

By adjusting the adjustment screws 16, the total mould insert, which is formed by the broad-side walls and end walls 2, 2′, 3, 3′, can be displaced normal to the longitudinal axis 7 of the mould cavity 8 without having to carry out manipulations on the lower side of the mould.

Figure 3:
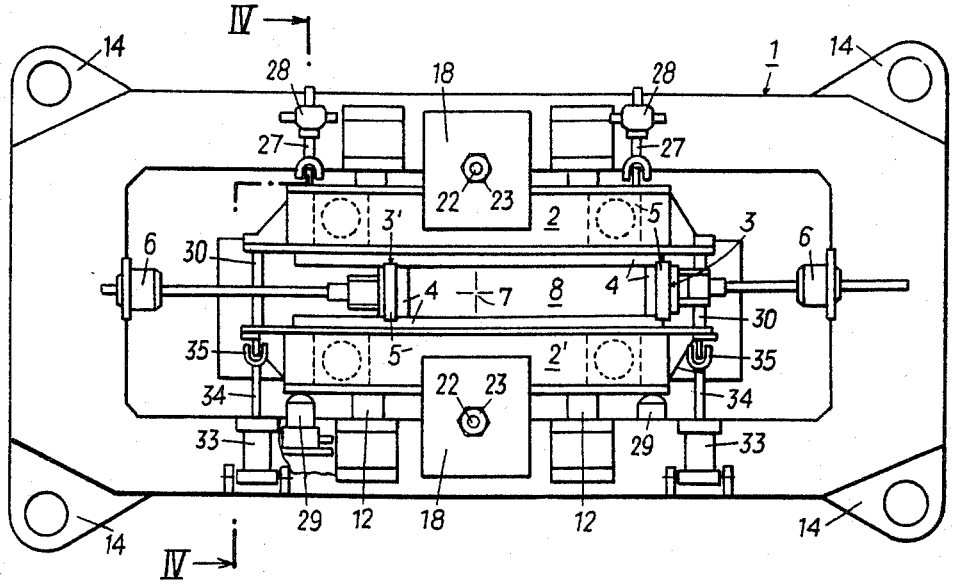
FIGS. 3 and 4 represent a further embodiment in illustrations analogous to FIGS. 1 and 2.
Figure 4:
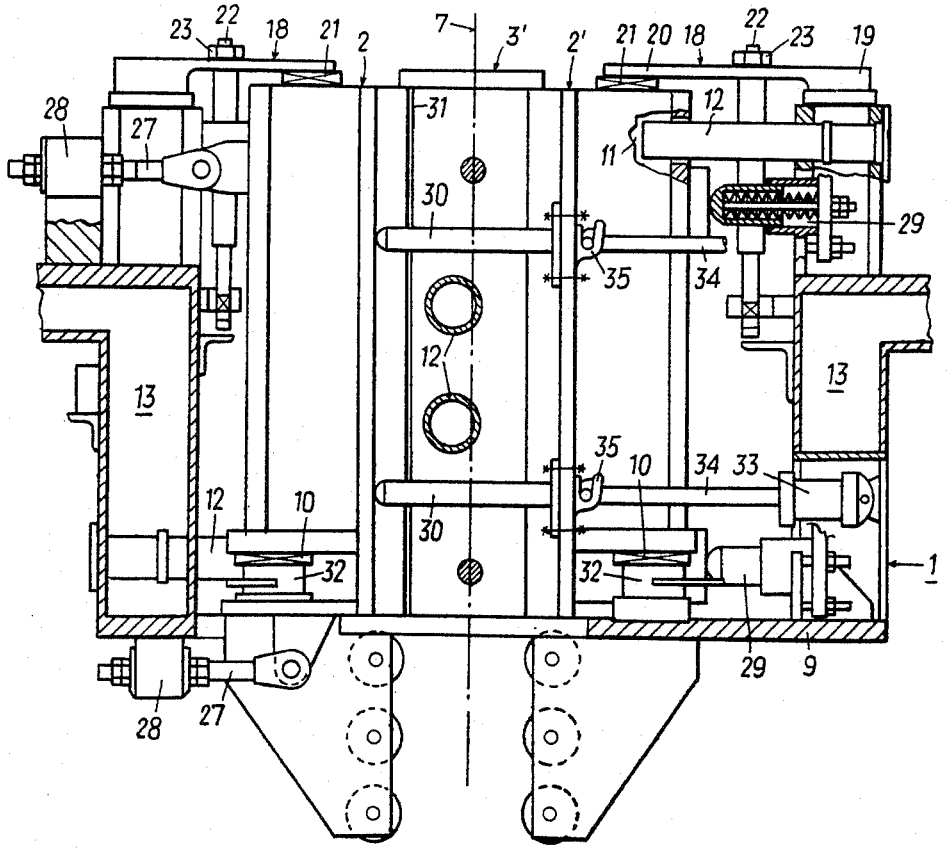

According to the embodiment illustrated in FIGS. 3 and 4, the broad-side wall forming the fixed side wall 2 is adjustable and fixable in its position by means of articulation rods 27 hinged to it and held on the carrying frame by means of articulation bearings 28. The oppositely arranged broad-side wall 2′ is pressed by means of spring cups 29 in the direction towards the fixed side wall, wherein, however, the end walls 3, 3′ in this case are not clamped between the broad-side walls 2, 2′, but spacers 30 are provided, ensuring a slight play 31 between the broadside walls and the end walls. On account of the spacers 30 it is possible to change the end walls during operation of the mould for the purpose of a change of format of the strand. Between the broad-side walls 2, 2′ and the holding plate, pressure measuring means 32, such as pressure pickups, are provided in addition to the bearings 10.

The tensioning means 22 for the clamp straps 18—in this case only one clamp strap 18 is provided for each side wall—is designed as a hammer head screw, the nut 23 lying above the clamp strap 18, thus being easily accessible from the upper side of the mould.

To displace the broad-side wall 2′ normal to the longitudinal axis 7 of the mould cavity 8, pressure medium cylinders 33 are provided. The cylinders 33 are inserted with their piston rods 34 in holding means 35 on the broad-side wall 2′.

What we claim is:

1. In a plate mould for continuous casting, in particular for continuously casting steel slabs, and of the type including a carrying frame, broad-side walls supported in said carrying frame, end walls arranged between said broad-side walls, said broad-side walls and said end walls defining a mould cavity, an adjustment means for displacing said broad-side walls normal to a longitudinal axis of said mould cavity, and clamping means for fixing said broad-side walls relative to each other with said end walls interposed therebetween, the improvement wherein said carrying frame comprises holding plate means arranged below and supporting said broad-side walls, at least one clamp strap is provided for each broad-side wall for clamping said broad-side wall against said holding plate means for restraining vertical movement of said broad-side wall relative to said holding plate means and said carrying frame while permitting movement of said broad-side walls in the direction normal to said longitudinal axis, said clamp strap having a first end supported on said broad-side wall and a second end supported on said carrying frame, said improvement further comprising a tensioning means for each of said clamp straps for clamping said clamp strap against said carrying frame, said tensioning means being accessible from above said mould.

2. A plate mould as set forth in claim 1, further comprising bearing means between each of said broad-side walls and said holding plate means, and between said first end of said clamp straps and said broad-side walls, to facilitate a displacing movement of said broad-side walls in the direction normal to said longitudinal axis of said mould.

3. A plate mould as set forth in claim 2, wherein said bearing means are designed as slide bearings.

4. A plate mould as set forth in claim 3, wherein said slide bearings have sliding surfaces of bronze.

5. A plate mould as set forth in claim 2, wherein said bearing means are designed as antifriction bearings.

6. A plate mould as set forth in claim 5, wherein said bearing means are designed as roundway bearings.

7. A plate mould as set forth in claim 1, wherein a first broad-side wall and a second broad-side wall are provided opposite each other, and further comprising adjustable stop means for supporting said first broad-side wall relative to said carrying frame, said second broad-side wall being pressable toward said first broad-side wall by said clamping means.

* * * * *